United States Patent [19]

Hein

[11] 4,030,852

[45] June 21, 1977

[54] COMPRESSION SEAL FOR VARIABLY SPACED JOINTS

[75] Inventor: Richard D. Hein, Wabash, Ind.

[73] Assignee: The General Tire & Rubber Company, Akron, Ohio

[22] Filed: July 15, 1975

[21] Appl. No.: 596,127

[52] U.S. Cl. ..... 404/66; 52/396; 49/498

[51] Int. Cl.[2] ..... E01C 11/10

[58] Field of Search ..... 404/67, 66, 68, 64; 49/498; 52/396

[56] References Cited

UNITED STATES PATENTS

| | | | |
|---|---|---|---|
| 1,733,880 | 10/1929 | Hurxthal | 49/498 |
| 2,139,780 | 12/1938 | Tea | 49/498 |
| 2,156,681 | 5/1939 | Dewhirst | 52/396 X |
| 2,220,628 | 11/1940 | Stedman | 52/396 X |
| 2,451,450 | 10/1948 | Spraragen | 49/498 |
| 3,387,544 | 6/1968 | MacLellan | 404/64 X |
| 3,504,597 | 4/1970 | Pare | 404/69 |

*Primary Examiner*—Nile C. Byers

[57] ABSTRACT

A generally hollow compression type elastomeric seal with integral metal ribs for lateral reinforcement and with integral fibers linking the metal ribs for reinforcment against longitudinal stretch. Seal is installed in compression in a space between adjacent members, such as paving or wall members, which space may vary with thermal expansion and contraction of such sections. As installed between paving members, seal is nominally rectangular in cross-section with generally curved upper and lower support walls, which are resilient and adapted to selectively resist buckling from horizontal compression when installed in compression between such sections, and with generally vertical sealing side walls adapted to be urged into sealing relation against adjacent vertical surfaces by the resistance to compression of such support walls. Metal ribs are vertically disposed in side walls and shaped to uniformly transmit force from support walls across the sealing faces of side walls and to restrain such sealing faces from vertical expansion when support walls are placed in horizontal compression. Linking fibers restrain seal from stretch during fabrication and subsequent use.

9 Claims, 8 Drawing Figures

COMPRESSION SEAL FOR VARIABLY SPACED JOINTS

BACKGROUND OF THE INVENTION

This invention generally relates to seals suitable for sealing a space which may vary between adjacent surfaces and more particularly relates to seals utilized to seal grooves or spaces which vary between sections of horizontal paving, vertical walls or the like due to the thermal expansion and contraction of such sections.

The invention as herein disclosed is an improvement in compression type seals of the nature disclosed in U.S. Pat. Nos. 2,156,681 to Dewhirst et al, 3,276,336 to Crone and 3,422,733 to Connell, for example. The integral reinforcing components of the seal of this invention, before being adapted for incorporation into the seal of this invention during its manufacture, are of the nature disclosed in U.S. Pat. No. 3,198,689 to Lansing.

In seals having inner webs of the kind shown by Crone, which are in wide and accepted commercial use, the vertical sides provide the sealing surfaces while the inner webs, along with the horizontal sides, act as a spring mechanism to supply force to the sealing areas. To distribute the sealing force, the webs must contact the vertical wall at several places.

One common problem with the internal webbed type seal is its tendency to stretch longitudinally as it is installed in compression within a joint, groove or space. Such stretch is difficult to control with seals formed solely of an extruded elastomer such as neoprene.

Another problem is that the inner webs of the web type seals are effectively shielded from external heat by dead air spaces and heat transfer to these webs for their proper vulcanization after extrusion is a more time consuming and cumbersome process.

SUMMARY OF THE INVENTION

This invention provides a compression seal having transverse metal reinforcing ribs and longitudinal reinforcing fibers in the sealing side walls of the seal which may be fabricated as an integral unit through extrusion in a cross head tubing process.

This invention provides a compression seal wherein all internal webs may be eliminated thereby directly exposing all parts of the seal to external vulcanizing heat to simplify and speed up vulcanization of the seal with reduced possibility of undetected internal undercures.

This invention provides a compression seal having a negligible tendency to stretch in length when being installed in compression within the space between adjacent sections of paving, for example.

This invention provides a compression seal having sidewalls reinforced with metal ribs adapted to evenly distribute a sealing force between the sidewalls and the surfaces of adjacent sections of paving.

The foregoing and other provisions and advantages are provided in a reinforced elastomeric seal adapted for installation in lateral compression within a longitudinal space or groove defined between the face-to-face surfaces of adjacent members to effect a seal between the member surfaces. The seal includes a hollow elongated resilient elastomeric body having two generally vertical side walls respectively presenting opposed external sealing surfaces adapted for engagement with the surfaces of the adjacent members within the space, a horizontally compressible upper buckling wall merging along its edges into the respective upper edges of the side walls, and a horizontally compressible lower buckling wall merging along its edges into the respective lower edges of the side walls. Both of these buckling walls are shaped in the form of buckling columns so that they build up resisting forces under compression that force the sealing surfaces of the side walls into sealing engagement with the surfaces of the adjacent members. A respective series of vertical spaced apart metal reinforcing ribs is disposed within each said side wall and along the length of each said side wall. The top and the bottom of each rib of the series of ribs may be respectively formed to extend generally horizontally within and into both a portion of said upper support wall and a portion of said lower support wall. The alternate adjacent top ends and the alternate bottom ends of each ribs of the series of ribs are joined together in a reverse curve configuration to form a metal member of continuous length for each series of reinforcing ribs. The ribs as formed are adapted to evenly distribute the resisting forces exerted by the upper and lower compressible support walls across the sealing surface of each said side wall. A series of fibers extends along and within the elastomeric body and links together the top, the midsection and the bottom of each rib of the series of reinforcing ribs to reinforce the elastomeric seal against stretch during both its fabrication and its use.

Further details of the construction and fabrication of the elastomeric seal of this invention appear below in the description of the preferred embodiments.

DESCRIPTION OF THE PREFERRED EMBODIMENTS

Figure 1:
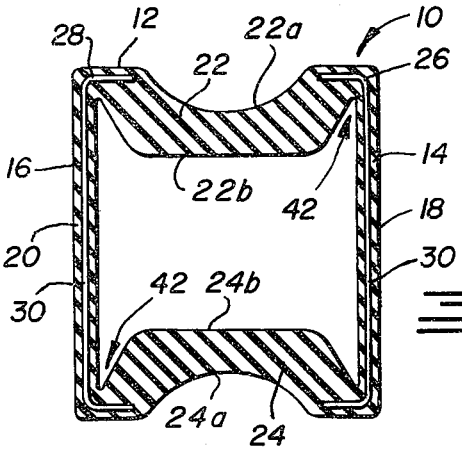
FIG. 1 is a vertical cross-sectional view of an embodiment of the seal of this invention with the seal disposed in a horizontal position.

FIG. 1 generally illustrates in cross-section the flexible reinforced elastomeric seal 10 of the present invention in a relaxed or uncompressed condition. Though not shown, seal 10 is manufactured in a continuous fashion and thus may be provided in lengths of a few meters to large spools of many meters as dictated by the conditions where the seal is to be installed. The seal may be provided of small cross-sectional dimension such as 2cm in width × 2cm in height or much larger. Seal 10 as illustrated in FIG. 1 may be about 1.75 inches (4.45 cm) in width and about 2.00 inches (5.08 cm) in height and, as shown in FIG. 8, may be compressed horizontally to about 1.00 inches (2.54 cm) when installed in the paving joint as illustrated.

Figure 8:
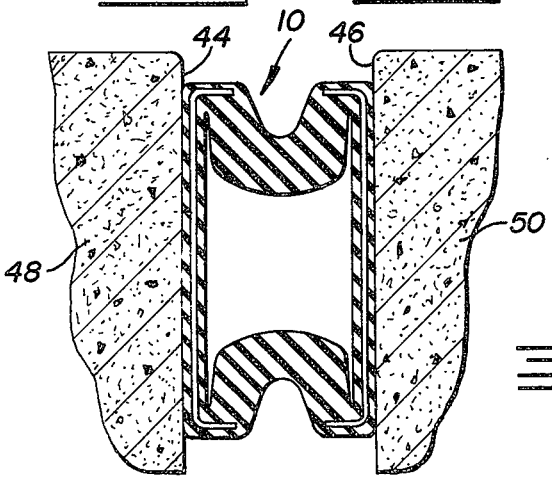
FIG. 8 is a vertical cross-sectional view showing a concrete paving joint including a seal of the present invention installed in compression within the space between the paving members or sections.

Though seal 10 is disclosed and claimed herein as being disposed in the horizontal position shown in FIGS. 1 and 8, it is to be understood that the seal may be used in any position such as in spaces between vertical and curved sections, for example.

As seen in FIG. 1, seal 10 includes an integral generally hollow elongated resilient elastomeric body 12. The body 12 is of one piece or unit construction, most desirably fabricated through an extrusion process as later described, and may be provided of various elastomeric compounds of natural rubber, styrene-butadiene rubber, ethylene-propylene rubber, Neoprene and the like. Neoprene is commonly used for such seals because of its resistance to ozone, wear, abrasion and petroleum products and also because of its ability not to become brittle at reasonably low ambient temperatures.

The body 12 includes two generally vertical side walls 14 and 16 with each side wall defining a sealing surface 18 and 20. Merging with the upper edges of side walls 14 and 16 is a horizontally compressible buckling wall 22 and merging with the lower edges of side walls 14 and 16 is a horizontally compressible wall 24. The buckling walls 22 and 24 are designed to buckle in horizontal compression, and to control the direction of this buckling, the upper surface of the upper buckling wall 22 preferably has a concave area **22*a* and the lower surface of the lower buckling wall has a concave area 24*a*. The opposite surfaces 22*b* and 24*b*** of these buckling walls are relatively flat.

Incorporated as integral elements within each of side walls 14 and 16 are a series of reinforcing ribs 26 and 28, respectively, with each series of ribs including a plurality of spaced apart ribs 30 which extend throughout the length of the body 12 of seal 10. As shown in FIGS. 1–3, 7 and 8, the ribs 30 are formed at their tops to extend partially into upper support wall 22 and at their bottoms to extend partially into lower support wall 24.

Figure 2:
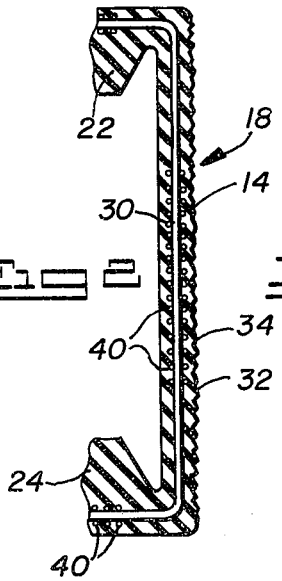
FIG. 2 is an enlarged portion of the view of FIG. 1 showing longitudinal grooves and crests on one of the two sealing surfaces of the seal.

FIG. 2 depicts an enlarged portion of body 12 including side wall 14 and portions of the support walls 22 and 24. As seen in FIG. 2, the sealing surfaces 18 and 20 may be formed as desired during the fabrication of seal 10 to present a series of grooves 32 and crests 34 along the length of body 12. Such a groove and crest arrangement gives added grip between the sealing surfaces and the walls of the joints to resist vertical movement and also enhances the effect of sealing against liquid leakage between the seal 10 and the faces 44 and 46 of paving members 48 and 50 as shown in FIG. 8, for example.

The concave areas **22*a* and 24*a* of the of upper and lower buckling walls allow the resilient walls to increasingly bend upwardly as the seal 10 is horizontally compressed. During the initial stages of this compression, the walls 22 and 24, backed by their relatively flat surfaces 22*b* and 24*a*, act much like springs and build up a significant resisting force. Then, as these walls buckle, this resisting force of the walls to compression is relatively constant through a considerable distance through which the seal may be horizontally compressed. Eventually, of course, the opposite sides of the curved walls 22 and 24 would engage and, thereafter, considerably greater force would be necessary for further horizontal compression of seal 10. Of note is that the thickness of the walls 22 and 24 are formed to diminish toward the junctures where the edges of the walls 22 and 24 merge with the side walls 14 and 16, leaving clearance spaces 42 into which the elastomer of walls 22 and 24** may move as the walls bend under horizontal compression.

The resistance to compression of the elastomer in the walls 22 and 24 built up during the initial stages of compression provides the force or spring mechanism to force the sealing surfaces 18 and 20 into sealing engagement with faces 44 and 46 as shown in FIG. 8. The reinforcing ribs 30 serve to distribute the force across sealing surfaces 18 and 20.

Figure 7:
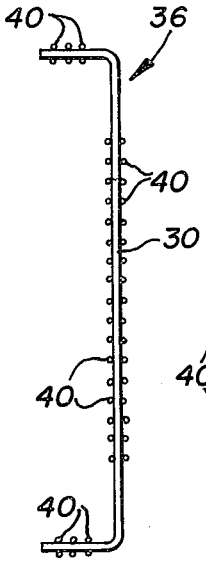
FIG. 7 is an end view of the reinforcing rib configuration of FIG. 6 after the ends of the ribs have been formed into shape for extrusion within the seal as shown in FIGS. 1 and 2.
Figure 6:
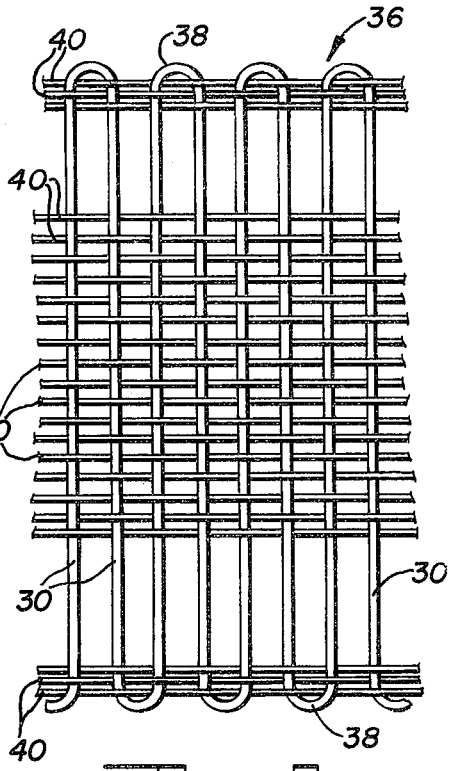
FIG. 6 is a side elevational view showing a configuration of a series of the side wall reinforcing ribs linked together as by stitching with thread fibers at the top, midsection and bottom of the ribs to reinforce the ribs and the fabricated seal against being stretched in length.

Referring to FIGS. 6 and 7, there is shown a series of reinforcing ribs designated series 26 and 28 in FIG. 1. As seen in FIG. 6 the reinforcing ribs 30 are formed of a continuous metal wire or rod member 36 in a shape which is generally on a plane and which is convoluted at reverse curve configurations 38 to dispose the ribs 30 in generally parallel spaced apart relationship as shown.

At the midsection, top and bottom of the series of ribs 30 the ribs are linked together by a plurality of strands of fibers 40 which may be interwoven or stitched with the ribs 40 such as with a lockstitch, for example. Each of the fibers 40 may be provided of single or multiple filaments and be of any of several materials which are relatively non-stretchable and which will not be damaged in the heat required to vulcanize the elastomer forming body 12. Such fibers may be of polyester, fiberglass, cotton, nylon or fine metal wire, for example. The stitched series of ribs 30 as shown in FIG. 6 may be provided in the form as shown and in rolls of convenient length from specialty manufacturers such as The Schlegel Manufacturing Company, Rochester, New York, U.S.A., for example. The ends of the series of ribs 30 are broken or bent over to an angle of about 90° as shown in FIG. 7, for incorporation as later described into the body 12 of seal 10 as shown in FIG. 1.

Figure 3:
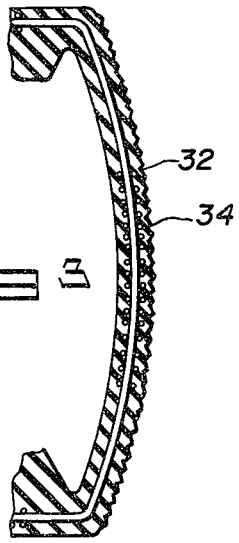
FIG. 3 is similar to FIG. 2 but showing the side wall and sealing surface curved slightly outward as an alternate embodiment of the seal.

FIG. 3 shows a structural variation from the structure shown in FIGS. 1 and 2 wherein the sidewalls 14 and 16 and the ribs 30 are formed with a slight curve extending horizontally outward from the body 12 of seal 10. As an alternate embodiment this curved structure would result in somewhat greater force being exerted at the horizontal midsection of sealing surfaces 18 and 20 due to the spring action of ribs 30 when the ribs are flexed into alignment with surfaces 44 and 46 of paving members 48 and 50 as shown in FIG. 8. Such alternate curved configuration of wall 14 and 16 may become desirable for some types and sizes of seal 10. The curved configuration of ribs 30 would then be formed at the time the ends are formed as shown in FIG. 7.

Figure 4:
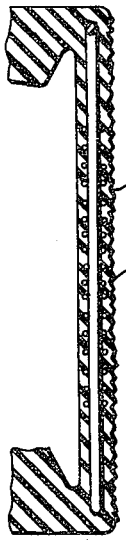
FIG. 4 is similar to FIG. 2 but showing the reinforcing ribs formed in an alternate manner.

FIG. 4 shows a variation of the structure of FIGS. 1 and 2 where the ends of the ribs 30 are not formed to extend into the upper and lower support walls 22 and 24. In the embodiment of FIG. 4, the series of support ribs 30 are essentially as shown in FIG. 6. Though the embodiments of FIGS. 1, 2 and 3 are considered to be structures of greater strength, the embodiments of FIG.

4 (and its outwardly curved alternate of FIG. 5) may be provided for very small sizes of the seal 10 wherein the walls of body 12 are relatively thin and the wire forming the ribs 30 is proportionately fine.

With reference to FIG. 6, it is to be noted that a stitched series of ribs 30 could be fabricated of individual ribs 30 and not the continuous wire or rod member 36 through the reverse curves 38. Such construction would lend problems to the extrusion process discussed hereafter, however, and the formation of the continuous member 36 into the stitched series as generally shown in FIG. 6 is preferred.

PREFERRED METHOD OF FABRICATION

The wire member 36 is first formed to shape the ribs 30 as shown in FIG. 6. The ends of the ribs 30 are then linked in spaced apart relation with at least one strand of fibers 40 and the center of the ribs 30 are also linked together with at least one strand of fibers 40. More than one strand of fibers may be linked at the rib ends and several strands of fibers may be linked at the midsection of the ribs, depending on the size of the seal 10, the size of the ribs 30 and the kind, size and tensile strength of the fibers 40.

Figure 5:
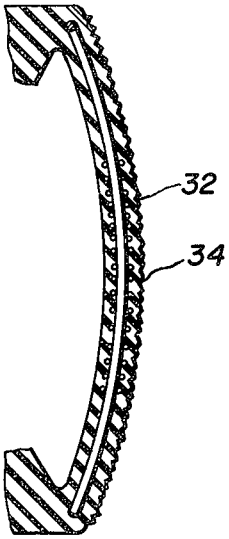
FIG. 5 is similar to FIG. 4 with the side wall and sealing surface formed in a slightly outward curve as shown in FIG. 3.

The series of ribs 30 is then formed into the shape shown in FIGS. 2, 3, or 5 by passing the series through an appropriate set of forming rollers, for example, which are generally arranged to form a pair of the stitched series of ribs 26 and 28 into a posture for incorporation into the body 12 as shown in FIGS. 1–5.

The series of ribs 26 and 28 are then introduced into and through a rubber extrusion apparatus commonly referred to in the rubber trade as a cross-head extruder or a cross-head tuber. The elastomer of body 12 is concurrently forced while in a plastic state into and around the series of ribs 26 and 28 and the rubber and the series of ribs 26 and 28 are extruded through an extrusion die having the internal and external shape of the body 12 as shown in FIGS. 2 or 4 (or FIGS. 3 or 5, if desired). The extruded body 12 is then passed through a curing oven at a sufficient temperature and resident time to completely vulcanize the elastomer. Since the body 12 is resistant to stretch by virtue of the fibers 40 with the series of ribs 26 and 28 as previously mentioned, the extrusion may be pulled to some extent as an aid in extrusion and curing without detrimental stretch and deformation of body 12.

After curing and cooling, the seal 10 may be cut and assembled into desired lengths or wound onto spools or reels in desired lengths for further handling and use.

If desired, the series of ribs 26 and 28 may be appropriately treated with a liquid rubber adhesive before being passed into the cross-head extruder to enhance the bond between the elastomer, the ribs and the fibers. As a practical matter, however, the adhesive dip or treatment has been found unnecessary when using the polyester fibers, steel ribs, and Neoprene elastomer, for example.

The foregoing description and drawing will suggest other embodiments and variations to those skilled in the art, all of which are intended to be included in the spirit of the invention as herein set forth.

I claim:

1. A reinforced elastomeric seal adapted for installation in lateral compression within a longitudinal space defined between the face to face surfaces of adjacent members to effect a seal between the member surfaces, comprising in combination: (a) a hollow elongated resilient elastomeric body having two generally vertical side walls respectively opposed external sealing surfaces adapted for engagement with said member surfaces, a horizontally compressible upper buckling wall merging along its edges into the respective upper edges of said side walls, and a horizontally compressible lower buckling wall merging along its edges into the respective lower edges of said side walls, said buckling walls having relatively thick central portions that buckle under compression and exert resisting forces that force said sealing surfaces of said side walls into sealing engagement with said member surfaces and said buckling walls also having relatively thin sloping edge portions adjacent said upper edges of said side walls that allow inward flexing of said buckling walls toward said side walls during said compression of the buckling walls; (b) a respective series of vertical spaced apart metal reinforcing ribs disposed within each said side wall and along the length of each said side wall with the top and the bottom of each rib of said ribs being respectively formed to extend generally horizontally within and into both a portion of said upper support wall and a portion of said lower support wall and with the alternate adjacent top ends and the alternate bottom ends of each rib of said series of said ribs being joined together in a reverse curve configuration and forming a metal member of continuous length for each series of reinforcing ribs, said ribs as formed being adapted to distribute the said resisting forces exerted by said upper and lower compressible buckling walls across the sealing surface of each said side wall; and (c) a series of fibers extending along and within said elastomeric body and linking together the top, the midsection and the bottom of each rib of said series of reinforcing ribs to reinforce said elastomeric seal against stretch during both its fabrication and its use.

2. The seal of claim 1 wherein said seal is adapted to be formed without substantial stretching when pulled during the extrusion and vulcanization of said elastomeric body.

3. The seal of claim 1 wherein said reinforcing ribs are formed of a continuous length of steel wire.

4. The seal of claim 1 wherein said fibers are polyester threads.

5. The seal of claim 1 wherein said ribs are stitched into linkage with said fibers.

6. A reinforced elastomeric seal adapted for installation in lateral compression within a longitudinal space defined between the face to face surfaces of adjacent members to effect a seal between the member surfaces, comprising in combination: (a) a hollow elongated resilient elastomeric body having two generally vertical side walls respectively presenting opposed external sealing surfaces adapted for engagement with said member surfaces, a horizontally compressible upper buckling wall merging along its edges into the respective upper edges of said side walls, and a horizontally compressible lower buckling wall merging along its edges into the respective lower edges of said side walls, said buckling walls having relatively thick central portions that buckle under compression and exert resisting forces that force said sealing surfaces of said side walls into sealing engagement with said member surfaces and said buckling walls also having relatively thin sloping edge portions adjacent said upper edges of said side walls that allow inward flexing of said buckling walls toward said side walls during said compression of the buckling walls; (b) a respective series of vertical spaced apart metal reinforcing ribs disposed within each said side wall and along the length of each said side wall with the top and the bottom of each rib of said ribs being respectively formed to extend generally horizontally within and into both a portion of said upper support wall and a portion of said lower support wall and with the alternate adjacent top ends and the alternate bottom ends of each rib of said series of said ribs being joined together in a reverse curve configuration and forming a metal member of continuous length for each series of reinforcing ribs, said ribs as formed being adapted to distribute the said resisting forces exerted by said upper and lower compressible buckling walls across the sealing surface of each said side wall; and (c) a series of fibers extending along and within said elastomeric body and linking together each rib of said series of reinforcing ribs to reinforce said elastomeric seal against stretch during both its fabrication and its use.

7. The seal of claim 6 wherein said ribs are stitched into linkage with said fibers.

8. The seal of claim 6 wherein said sealing surfaces are grooved to define a plurality of longitudinally extending sealing crests and grooves.

9. The seal of claim 6 wherein said fibers include strong thin flexible tensile members as a group.

* * * * *